US012313337B2

(12) United States Patent
Mak et al.

(10) Patent No.: US 12,313,337 B2
(45) Date of Patent: May 27, 2025

(54) SYSTEMS AND METHODS FOR LNG REFRIGERATION AND LIQUEFACTION

(71) Applicant: Fluor Technologies Corporation, Sugar Land, TX (US)

(72) Inventors: John Mak, Santa Ana, CA (US); Jacob Thomas, Sugar Land, TX (US)

(73) Assignee: Fluor Technologies Corporation, Irving, TX (US)

( * ) Notice: Subject to any disclaimer, the term of this patent is extended or adjusted under 35 U.S.C. 154(b) by 1671 days.

(21) Appl. No.: 16/297,000

(22) Filed: Mar. 8, 2019

(65) Prior Publication Data

US 2019/0204006 A1 Jul. 4, 2019

Related U.S. Application Data

(63) Continuation of application No. 15/344,548, filed on Nov. 6, 2016, now abandoned.

(Continued)

(51) Int. Cl.
*F25J 1/02* (2006.01)
*F25J 1/00* (2006.01)

(52) U.S. Cl.
CPC ..... *F25J 1/0022* (2013.01); *F25J 1/004* (2013.01); *F25J 1/0042* (2013.01); *F25J 1/005* (2013.01); *F25J 1/0052* (2013.01); *F25J 1/0072* (2013.01); *F25J 1/0082* (2013.01); *F25J 1/0204* (2013.01); *F25J 1/0212* (2013.01); *F25J 1/023* (2013.01);

(Continued)

(58) Field of Classification Search
CPC ..... F25J 1/0022; F25J 1/0042; F25J 1/005; F25J 1/0242; F25J 1/0289; F25J 2240/30; F25J 2240/80; F25J 2240/82; F25J 2240/90; F25J 2245/90; F25J 2260/02;

(Continued)

(56) References Cited

U.S. PATENT DOCUMENTS 3,857,245 A 12/1974 Jones
3,885,394 A 5/1975 Witt et al.

(Continued)

FOREIGN PATENT DOCUMENTS

CA 3003614 A1 5/2017
CN 104266454 A 1/2015

(Continued)

OTHER PUBLICATIONS

Office Action dated Sep. 5, 2019, U.S. Appl. No. 15/344,548, filed Nov. 6, 2016.

(Continued)

*Primary Examiner* — John F Pettitt, III
(74) *Attorney, Agent, or Firm* — Andrew Metrailer; Ryan D Jenlink; Conley Rose, P.C.

(57) ABSTRACT

A LNG liquefaction plant system includes concurrent power production, wherein the refrigeration content of the refrigerant or SMR is used to liquefy and sub-cool a natural gas stream in a cold box or cryogenic exchanger. For concurrent power production, the system uses waste heat from refrigerant compression to vaporize and superheat a waste heat working fluid that in turn drives a compressor for refrigerant compression. The refrigerant may be an external SMR or an internal LNG refrigerant working fluid expanded and compressed by a twin compander arrangement.

15 Claims, 6 Drawing Sheets

Related U.S. Application Data

(60) Provisional application No. 62/252,247, filed on Nov. 6, 2015, provisional application No. 62/251,808, filed on Nov. 6, 2015.

(52) U.S. Cl.
CPC ..... *F25J 1/0242* (2013.01); *F25J 1/025* (2013.01); *F25J 1/0281* (2013.01); *F25J 1/0283* (2013.01); *F25J 1/0285* (2013.01); *F25J 1/0288* (2013.01); *F25J 1/0289* (2013.01); *F25J 2210/06* (2013.01); *F25J 2220/64* (2013.01); *F25J 2230/20* (2013.01); *F25J 2230/60* (2013.01); *F25J 2240/30* (2013.01); *F25J 2240/70* (2013.01); *F25J 2240/82* (2013.01); *F25J 2240/90* (2013.01); *F25J 2245/90* (2013.01); *F25J 2260/02* (2013.01); *F25J 2270/16* (2013.01); *F25J 2270/18* (2013.01); *F25J 2270/60* (2013.01)

(58) Field of Classification Search
CPC .... F25J 2270/16; F25J 2270/60; F25J 1/0281; F25J 1/0283; F25J 1/023
See application file for complete search history.

(56) References Cited

U.S. PATENT DOCUMENTS

| | | | | |
|---|---|---|---|---|
| 4,901,533 | A | 2/1990 | Fan et al. | |
| 6,158,240 | A | 12/2000 | Low et al. | |
| 6,446,465 | B1 | 9/2002 | Dubar | |
| 6,964,168 | B1 | 11/2005 | Pierson et al. | |
| 8,925,320 | B1 | 1/2015 | Kalina | |
| 2007/0199606 | A1 | 8/2007 | Bronicki et al. | |
| 2012/0067080 | A1 | 3/2012 | Byfield et al. | |
| 2012/0204598 | A1 | 8/2012 | Mock et al. | |
| 2013/0061633 | A1 | 3/2013 | Mak et al. | |
| 2014/0083132 | A1 | 3/2014 | Maunder et al. | |
| 2014/0190205 | A1* | 7/2014 | Bonnissel | F25J 1/0204 62/614 |
| 2014/0260251 | A1 | 9/2014 | Shapot et al. | |
| 2014/0305160 | A1 | 10/2014 | Chong et al. | |
| 2017/0131027 | A1 | 5/2017 | Mak et al. | |

FOREIGN PATENT DOCUMENTS

| | | | | |
|---|---|---|---|---|
| EP | 0687353 | A1 | 12/1995 | |
| EP | 3371535 | A1 | 9/2018 | |
| KR | 1020150117635 | A | 10/2015 | |
| WO | 2009153143 | A1 | 12/2009 | |
| WO | 2010063789 | A2 | 6/2010 | |
| WO | WO-2013184068 | A1 * | 12/2013 | F25J 1/0278 |
| WO | 2014165188 | A1 | 10/2014 | |
| WO | 2017079711 | A1 | 5/2017 | |

OTHER PUBLICATIONS

European Extended Search Report dated Oct. 1, 2019, European Application No. 16863141.4 filed May 3, 2018.
Communication pursuant to Rules 70(2) and 70a(2) EPC dated Oct. 18, 2019, European Application No. 16863141.4 filed May 3, 2018.
Chacartegui, R. et al., "Alternative ORC Bottoming Cycles for Combined Cycle Power Plants", Applied Energy, vol. 86, 2009, pp. 2162-2170.
Howe, B., "Dual Expander Methane Cycle Liquefaction Technology Applied to FLNG", Gastech Conference Newspaper, XP007922814, Mar. 24, 2014, pp. 8-9.
Office Action dated Feb. 5, 2018, U.S. Appl. No. 15/344,548, filed Nov. 6, 2016.
Office Action dated May 16, 2018, U.S. Appl. No. 15/344,548, filed Nov. 6, 2016.
International Search Report & Written Opinion, dated Feb. 16, 2017, International Application No. PCT/US2016/060756, filed Jun. 20, 2012.
International Preliminary Report on Patentability, dated May 17, 2018, International Application No. PCT/US2016/060756, filed Jun. 20, 2012.
Communication Pursuant to Rules 161(2) and 162 EPC dated Jun. 13, 2018, European Application No. 16863141.4 filed May 3, 2018.
Mak, Jon, et al., "Methods and Configuration for LNG Liquefaction ORC-SMR Process," filed on Nov. 6, 2015; U.S. Appl. No. 62/251,808.
Mak, Jon, et al., "Methods and Configuration for LNG Liquefaction ORC-Expander Process," filed on Nov. 6, 2015; U.S. Appl. No. 62/252,247.
Final Office Action dated May 8, 2019, U.S. Appl. No. 15/344,548, filed Nov. 6, 2016.
Advisory Action dated Jul. 23, 2019, U.S. Appl. No. 15/344,548, filed Nov. 6, 2016.
Communication Pursuant to Rule 164(1) EPC dated May 13, 2019, European Application No. 16863141.4 filed May 3, 2018.

* cited by examiner

SYSTEMS AND METHODS FOR LNG REFRIGERATION AND LIQUEFACTION

CROSS-REFERENCE TO RELATED APPLICATIONS

This application is a continuation of U.S. patent application Ser. No. 15/344,548, filed on Nov. 6, 2016 and entitled "Systems and Methods for LNG Refrigeration and Liquefaction," which claims the benefit of: 1) U.S. Provisional Patent Application Ser. No. 62/251,808, filed on Nov. 6, 2015, and entitled "Methods and Configurations for LNG Liquefaction ORC-SMR Process," and 2) U.S. Provisional Patent Application Ser. No. 62/252,247, filed on Nov. 6, 2015 and entitled "Methods and Configurations for LNG Liquefaction ORC-Expander Process," all of which are incorporated herein by reference in their entirety.

STATEMENT REGARDING FEDERALLY SPONSORED RESEARCH OR DEVELOPMENT

Not applicable.

BACKGROUND

Hydrocarbon drilling and production systems can include the extraction of natural gas from wellbores in subterranean earthen formations. For ease of transport or storage, the natural gas can be liquefied. The liquefaction process includes condensing the natural gas into a liquid by cooling, or refrigeration. The liquefied natural gas (LNG) can then be moved and stored more efficiently. Prior to condensing, the natural gas can be treated or processed to remove certain components such as water, dust, helium, mercury, acid gases such as hydrogen sulfide and carbon dioxide, heavy hydrocarbons, and other components.

Liquefaction of LNG requires significant quantities of thermal energy, and typical LNG liquefaction facilities employ internal or external refrigerant sources to liquefy LNG prior to storage and delivery. For example, external refrigerant sources include a single mixed refrigerant (SMR) with different compositions of nitrogen, methane, ethane, mixed butanes and iso-pentane components. Depending on the particular refrigerant media, the LNG cryogenic heat exchangers may be configured as plate fin, printed circuit or spiral wound heat exchangers. Furthermore, LNG liquefaction also requires a reliable power supply to operate refrigerant compressors and pumps for delivery of liquefied LNG product. Some LNG liquefaction facilities use internal refrigerant sources. For example, boil off gas (BOG) generated from the LNG itself can be used as the internal refrigerant source.

With significant thermal energy and reliable power supply needed for LNG liquefaction, energy efficiency and reduction in greenhouse gas generation is desirable.

BRIEF DESCRIPTION OF THE DRAWINGS AND TABLES

For a detailed description of exemplary embodiments, reference will now be made to the accompanying drawings in which.

DETAILED DESCRIPTION

Figure 1:
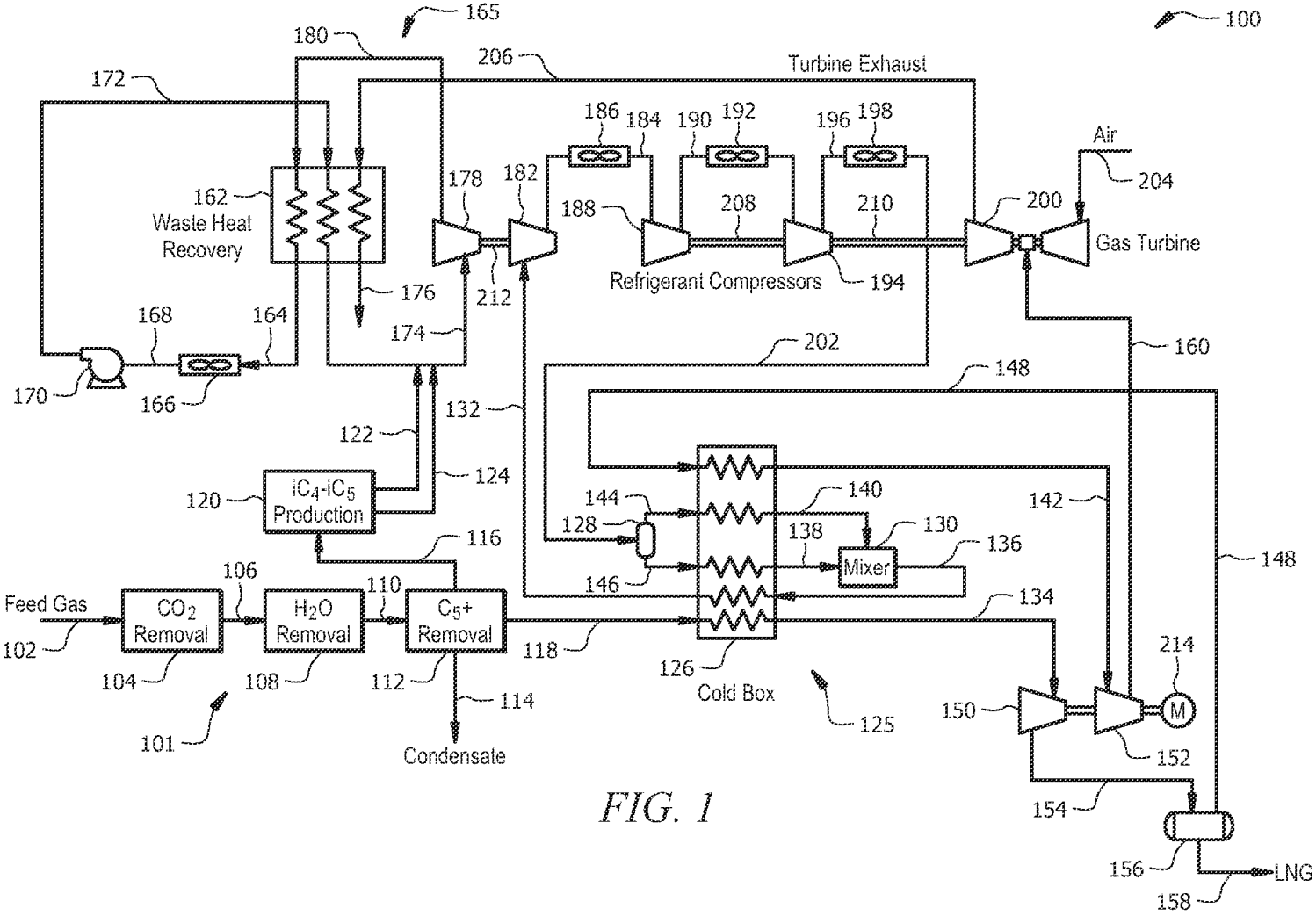
FIG. 1 is an equipment and process flow diagram for an embodiment of a LNG liquefaction plant or system using an external refrigerant in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

In various embodiments described below, a LNG liquefaction plant or system includes concurrent power production. In some embodiments, the LNG liquefaction plant uses waste heat recovered from a refrigeration unit for concurrent power production. In some embodiments, a hydrocarbon is used as a working fluid in a specially configured organic Rankine cycle (ORC). In certain embodiments, the LNG liquefaction plant includes closed cycle power production with an external refrigerant, such as a single mixed refrigerant (SMR), and a light hydrocarbon as a working fluid. These and other embodiments will be described in more detail below.

Referring to FIG. 1, a LNG liquefaction plant or system 100 includes a treatment system 101, a heat exchanger system 125, and a waste heat recovery system 165. A natural gas feed conduit 102 is coupled to an acid gas removal unit 104, which in turn is coupled to a conduit 106, a dehydration unit 108, a conduit 110, a heavy hydrocarbon removal unit 112, a condensate conduit 114, a conduit 116, and a conduit 118. The conduit 116 is coupled to a debutanizer-depentanizer 120, which also includes conduits 122, 124. It is understood that various combinations and arrangements of treatment units is contemplated beyond the exemplary configuration described above.

The conduit 118 carries a treated gas stream to a cold box, or cryogenic exchanger, 126 of the heat exchanger system 125. The cold box 126 is coupled to a conduit 132, a conduit 134, a conduit 138, a conduit 140, and a conduit 148. The conduit 138 is coupled to a mixing device 130 which is coupled to a conduit 136 that couples back into the cold box 126. Conduits 144, 146 are coupled into the cold box 126 with a separator 128 coupled between the conduits 144, 146. The conduit 134 couples to a hydraulic turbine or expander 150. The turbine 150 is coupled to a conduit 154 and a storage tank 156, as well as a compressor 152. A conduit 142 couples between the compressor 152 and the cold box 126. The conduit 148 couples between the storage tank 156 and the cold box 126. A conduit 158 is coupled to the storage tank 156.

The waste heat recovery system 165 is coupled to the heat exchanger system 125. The waste heat recovery system 165 includes a waste heat recovery unit 162. An air cooler 166 and a pump 170 are coupled to the waste heat recovery unit 162 via a series of conduits 164, 168, 172. A high pressure expander 178 is coupled into the waste heat recovery unit 162 via conduits 174, 180. The high pressure expander 178 may also be referred to as a turbo-expander. The high pressure expander 178 is operationally coupled to a refrigerant compressor 182 by a drive shaft 212. In some embodiments, the system 100 includes multiple stages of refrigerant compression, and thus the compressor 182 may also be referred to as a first refrigerant compressor. A conduit 184 is coupled to the first refrigerant compressor 182 and to a second refrigerant compressor 188, and an air cooler 186 is coupled into the conduit 184. A conduit 190 is coupled to the second refrigerant compressor 188 and to a third refrigerant compressor 194, and an air cooler 192 is coupled into the conduit 190. A conduit 196 is coupled between the third refrigerant compressor 194 and an air cooler 198. A conduit 202 is coupled between the air cooler 198 and the separator 128. The second refrigerant compressor 188 is operationally coupled to the third refrigerant compressor 194 by a drive shaft 208, and the third refrigerant compressor 194 is operationally coupled to a compressor driver, or turbine or gas turbine, 200. The turbine 200 may also be referred to as an expander or turbo-expander. A conduit 206 is coupled to the turbine 200 and couples back into the waste heat recovery unit 162. A conduit 160 is coupled between the turbine 200 and the compressor 152. A conduit 204 also couples into the turbine 200.

In operation, a natural gas feed stream is directed through the conduit 102. In some embodiments, the feed rate is 150 MMscfd (from a pipeline or other source) and may be at a pressure of 900 psig and at a temperature of about 95° F., or alternatively about 70° F. It will be understood that various quantitative values are provided herein for illustrative purposes, are approximations of the quantities given, and are exemplary only. The feed gas is treated in the acid gas removal unit 104, the dehydration unit 108, and the heavy hydrocarbon removal unit 112 for removal of $H_2S$, $CO_2$, $H_2O$, and $C_5$+, which may be required to meet a LNG product specification and/or to avoid freeze-out in the cold box 126. The feed gas is also treated in the debutanizer-depentanizer 120 for the production of iso-butane and iso-pentane which can be used as makeup for the working fluid in the ORC power generation as described hereinbelow.

A treated gas stream is directed through the conduit 118 and into the cold box 126 of the heat exchanger unit 125. In some embodiments, the treated gas stream is at a pressure of 870 psig and a temperature of 95° F. A refrigerant is directed from the third refrigerant compressor 194 and its discharge stream in the conduit 202 to the separator 128 where the stream is split into a liquid stream in the conduit 146 and a vapor stream in the conduit 144. In some embodiments, the refrigerant working fluid is a single mixed refrigerant (SMR). As will be readily appreciated, the particular composition of the working fluid is generally determined by the specific composition of the feed gas, the LNG product, and the desired liquefaction cycle pressures. It may also be desirable to vary the working fluid compositions and/or cycle operating pressures as necessary to maximize liquefaction.

The refrigerant streams 144, 146 are used for liquefaction and sub-cooling of LNG in the cold box 126. The liquid stream 146 and the vapor stream 144 are directed to the cold box 126 in their respective exchanger stages to facilitate LNG liquefaction and to thereby produce cooled liquid streams in the conduits 138, 140. The cooled liquid streams 138, 140 are directed through the mixing device 130 and expanded. In some embodiments, the cooled liquid streams are expanded to 32 psig. The expanded liquid streams are directed to the next heat exchange stage via the conduit 136 back into the cold box 126 and the conduit 132 from the cold box 126 to recycle the stream back to the first refrigerant compressor 182. Consequently, a liquefied and sub-cooled LNG stream is generated in the cold box 126 and directed through the conduit 134. In some embodiments, the LNG stream 134 is at a pressure of 850 psig and −245° F. from the cold box 126 and is expanded across the hydraulic turbine 150 to produce a LNG product stream in the conduit 154. In some embodiments, the LNG product stream 154 is brought to nearly atmospheric pressure (>1.0 psig) and further sub-cooled to −258° F. and stored in the storage tank 156 for LNG export in the conduit 158. As described above, in various embodiments the refrigeration content of the refrigerant or SMR can be used in the LNG facility by using the refrigerant or SMR as a working fluid, wherein the refrigerant or SMR is compressed, cooled, expanded in a mixing device, and sub-cooled in multiple heat exchange stages in the cold box 126 (e.g., heat exchange stages of 144 to 140, 146 to 138, 138/140 to 136, 136 to 132, and 148 to 142).

The waste heat recovery system 165 includes the ORC wherein the working fluid is, in an exemplary embodiment, a high pressure hydrocarbon liquid in the conduit 172 that is pressurized by the pump 170. In some embodiments, the high pressure hydrocarbon liquid flows at a rate of 1,350 gpm, a temperature of 98° F., and a pressure of 580 psia. The high pressure hydrocarbon liquid is vaporized and superheated in the waste heat recovery unit 162 by heat from a turbine exhaust stream in the conduit 206. In some embodiments, the high pressure hydrocarbon liquid is superheated to about 650° F. to form a vapor stream in the conduit 174 exiting the waste heat recovery unit 162. The vapor stream is expanded across the high pressure expander 178. In some embodiments, the vapor stream is expanded to about 12 psig, or about 25 psia. The high pressure expander 178 is coupled by the drive shaft 212 to provide operational power to the first refrigerant compressor 182. In some embodiments, the expanded vapor stream in the conduit 180 is at about 530° F. The expanded vapor stream is delivered to the waste heat recovery unit 162 where it is cooled. In some embodiments, the expanded vapor stream is cooled to about 180° F. to form a cooled vapor stream in the conduit 164. The cooled vapor stream is then condensed in the air cooler 166 to form a saturated liquid stream in the conduit 168 that can be pumped by the pump 170 to recycle the hydrocarbon working fluid in a closed loop cycle. Consequently, in some embodiments, the waste heat recovery system 165 includes a closed loop hydrocarbon working fluid cycle. The hydrocarbon working fluid is cooled in the waste heat recovery unit 162 and condensed in the air cooler 166. The hydrocarbon working fluid is then pumped into the waste heat recovery stage including the gas turbine exhaust 206. The waste heat recovery system 165 is configured to use the gas turbine exhaust 206 to vaporize and superheat the high pressure hydrocarbon working fluid prior to sending it to the expander 178.

In other embodiments, the waste heat recovery working fluid may include other fluids. For example, the working fluid may be a hydrocarbon or a non-hydrocarbon, provided the boiling temperature is suitable for condensation at the ambient temperature at the liquefaction site. Thus, in a colder climate area, a lighter hydrocarbon such as isobutane may be used. In a warmer climate area, a heavier hydrocarbon such as isopentane may be used. In some embodiments, the working fluid can be changed or adjusted depending on the temperature at the same liquefaction site. For example, a lighter hydrocarbon can be used during winter operation, while the lighter hydrocarbon can be replaced with a heavier hydrocarbon in the summer. In some embodiments, the change in waste heat recovery working fluid can maximize power output from the waste heat ORC, thereby increasing overall energy efficiency. In some embodiments, a waste heat working fluid hydrocarbon can be extracted from the feed section of the LNG plant in a fractionation column. In some embodiments, components of the waste heat recovery working fluid can be extracted from the feed from the heavy hydrocarbon removal unit 112. For example, a $C_5$+ stream is directed from the heavy hydrocarbon removal unit 112 by the conduit 116 to the debutanizer-depentanizer 120, and then by the conduits 122, 124 to the working fluid stream in the conduit 174 of the waste heat recovery ORC loop.

As the high pressure expander 178 drives the first refrigerant compressor 182, the expanded refrigerant stream in the conduit 132 is directed into the first refrigerant compressor 182 for first stage compression. The compressed refrigerant stream in the conduit 184 is cooled by the air cooler 186 and directed into the second refrigerant compressor 188 for second stage compression. The compressed refrigerant stream in the conduit 190 is cooled by the air cooler 192 and directed into the third refrigerant compressor 194 for third stage compression. The compressed refrigerant stream in the conduit 196 is cooled by the air cooler 198 and directed into the conduit 202 and toward the separator 128 for use by the heat exchange system 125. In some embodiments, the SMR vapor stream from the multi-stage compressor assembly 182, 188, 194 is cooled to ambient temperature by the air coolers 186, 192, 198.

The gas turbine, or turbo-expander, 200 is used to drive the compressors 188, 194 via the drive shafts 208, 210. The conduit 206 carries waste heat in the form of turbine exhaust from the gas turbine 200 to the waste heat recovery unit 162 to provide heat to the closed loop ORC of the waste heat recovery system 165 that in turn drives the high pressure expander 178 and the first refrigerant compressor 182 as described above. The turbine exhaust can then exit the waste heat recovery unit 162 via the conduit 176. To power the gas turbine 200, a fuel gas stream in the conduit 160 must be provided. First, the refrigeration content of a LNG boil off gas stream on the conduit 148 from the storage tank 156 is used to optimize the liquefaction of LNG in the cold box 126. After providing cooling in the cold box 126, the stream is carried in the conduit 142 to the compressor 152 where it is compressed and then directed to the gas turbine 200 in the conduit 160 as the fuel gas stream. The hydraulic turbine 150 powers the compressor 152. In some embodiments, supplemental power for the compressor 152 can be provided by an electric motor 214. In some embodiments, power required for the compressor 152 can be supplied from the power generation of the closed loop ORC. For example, similar to the way the expander 178 is driven, the high pressure hydrocarbon vapor stream in the conduit 174 can be coupled to the hydraulic turbine 150 (not shown) for power.

Consequently, in various embodiments described above, a refrigeration and liquefaction plant system is provided including concurrent power production. In certain embodiments, the refrigeration content of LNG is also employed as a heat sink in LNG liquefaction. For example, vaporized LNG from LNG tanks and ships may be coupled with LNG liquefaction, where a refrigeration source, i.e., the SMR as described above, is compressed, cooled, expanded and recompressed via the twin turbo-expander compressor assembly (e.g., the expanders 178, 200 and the compressors 182, 188, 194) and the cold box 126 in a closed loop cycle. Recovered waste heat from the turbo-expander 200 exhaust stream is used to vaporize the hydrocarbon working fluid in the waste heat recovery unit 162. The hydrocarbon working fluid is then expanded through the turbo-expander 178, condensed, and recycled back in a closed loop ORC. The ORC driven turbo-expander 178 in turn drives the first stage refrigerant compressor 182, thereby increasing energy efficiency. Consequently, in some embodiments, power typically provided from an external power grid can be reduced by the amount of internally produced power. With such a reduction in net power consumption, LNG liquefaction can be achieved while reducing undesirable amounts of waste streams, emissions, and greenhouse gases. In some embodiments, the systems and processes described herein are implemented in new LNG liquefaction plant systems, while in other embodiments the systems and processes are used to retrofit existing LNG liquefaction plant systems. In some embodiments, the systems and processes described herein can address or eliminate the need to install emission reduction or control devices, such as a selective catalytic reduction (SCR) device, on the turbine exhaust 206.

Figure 2:
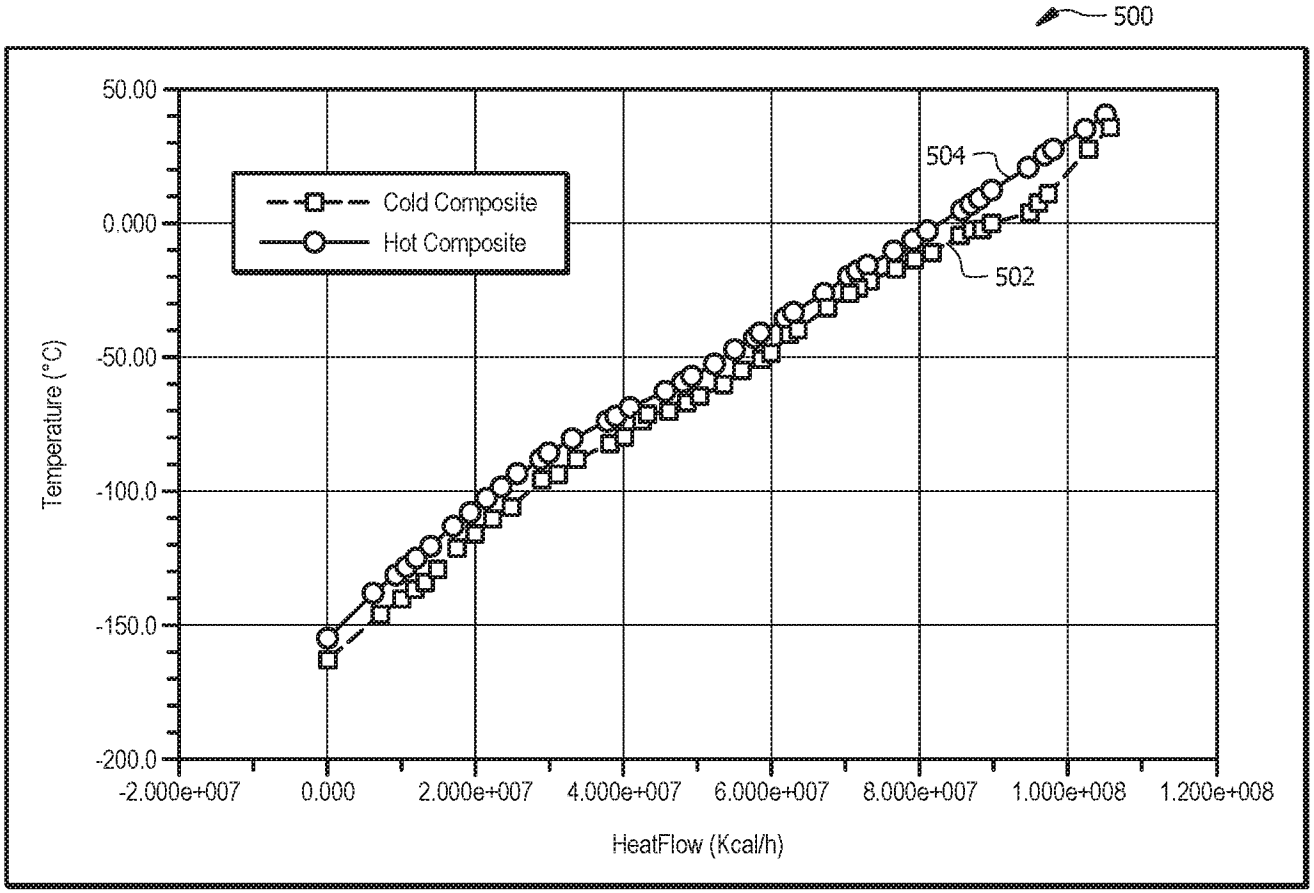
FIG. 2 is a diagram showing the composite heat curves between LNG and an external refrigerant as a working fluid using a cold box.

As described above, the refrigeration content of both the LNG, via the LNG stream 148 directed into the cold box 126, and the refrigerant working fluid, via the compressed and cooled refrigerant stream 202 directed through multiple heat exchange stages of the cold box 126, are used for LNG liquefaction in various embodiments described herein. Referring to FIG. 2, a graph 500 shows a composite heat curve 502 for the SMR refrigerant working fluid and a composite heat curve 504 for the LNG, using heat flow (kcal/h) as a function of temperature (° C.).

Figure 3:
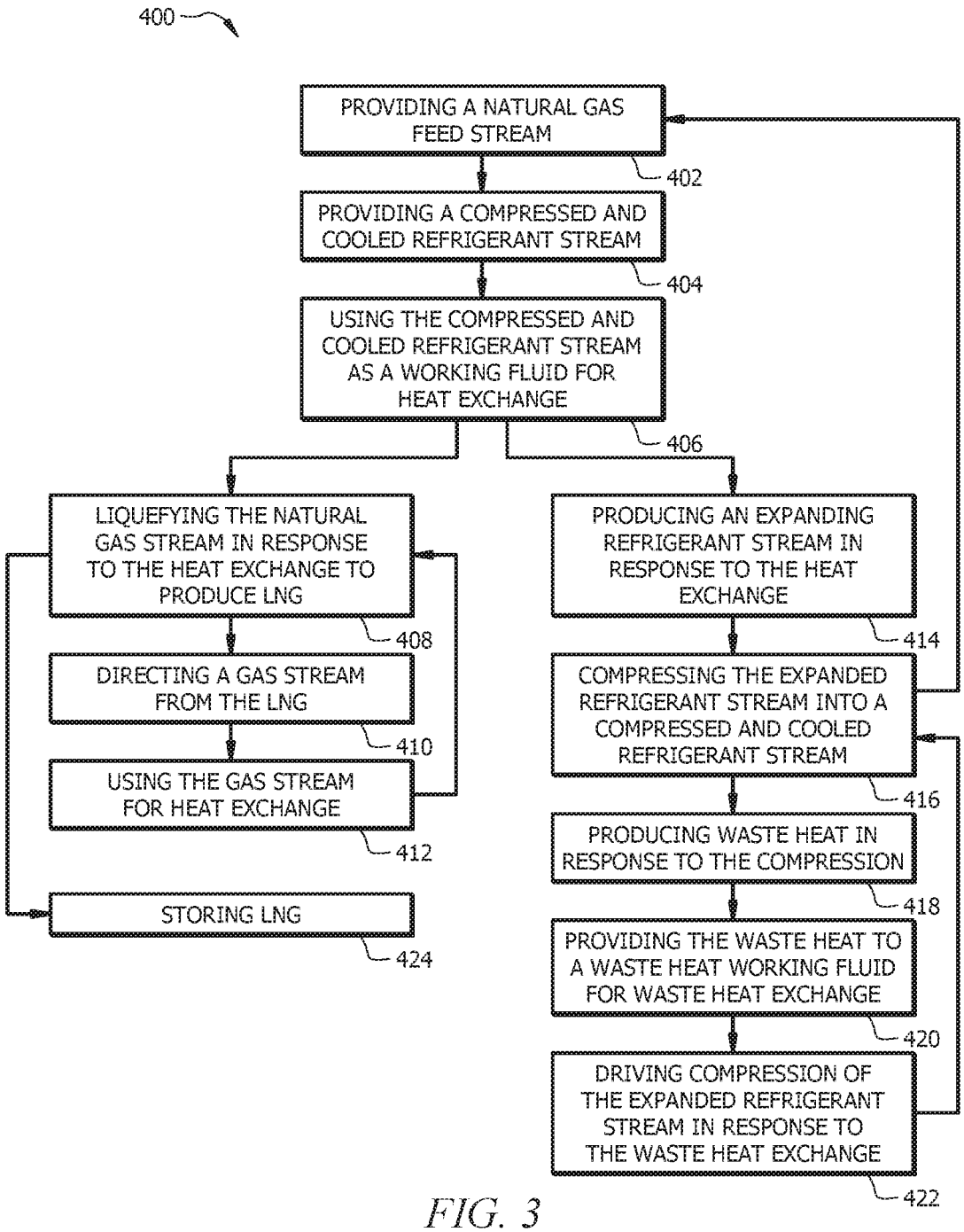
FIG. 3 is a flow chart for an embodiment of a method of LNG liquefaction using an external refrigerant in accordance with principles disclosed herein.

The systems described above can be used for various methods of liquefying and sub-cooling LNG. Referring now to FIG. 3, a method 400 includes providing a natural gas stream 402 and providing a compressed and cooled refrigerant stream 404. Next, the method 400 includes using the compressed and cooled refrigerant stream as a working fluid for heat exchange 406, such as, for example, in the multiple stages of heat exchange in and adjacent the cold box or cryogenic exchanger 126. Then, the method 400 includes using the refrigerant heat exchange to liquefy the natural gas into LNG 408. A gas stream, such as the LNG vapor or boil off gas, is directed from the LNG stream 410 and used for heat exchange 412. Such heat exchange can also be used for the LNG liquefaction step 408. After refrigerant heat exchange at step 406, the method 400 also includes producing an expanded refrigerant stream in response to the heat exchange 414. Next, the method 400 includes compressing the expanded refrigerant stream into a compressed and cooled refrigerant stream 416, which can then feed into the providing the refrigerant stream at step 404. Also as a result of refrigerant compression 416, waste heat is produced at step 418, such as, for example, the turbine exhaust in the conduit 206. Then, the method 400 includes providing waste heat to a waste heat working fluid for waste heat exchange 420, such as, for example, by using the waste heat recovery unit 162. The waste heat exchange can then be used to drive compression of the expanded refrigerant stream 422, such as, for example, by sending the waste heat working fluid through the expander 178 to drive the compressor 182. Driving compression 422 then feeds back into the refrigerant compression step 416. Finally, as a result of these various steps, the method 400 includes storing LNG 424. It is noted that the steps above can be performed in varying orders and portions of the method can be performed apart from other portions as desired. For example, using the refrigerant as a working fluid for heat exchange can be performed regardless of using a LNG vapor stream for liquefaction or using waste heat in the system to heat a working fluid and drive compression, and vice versa.

Figure 4:
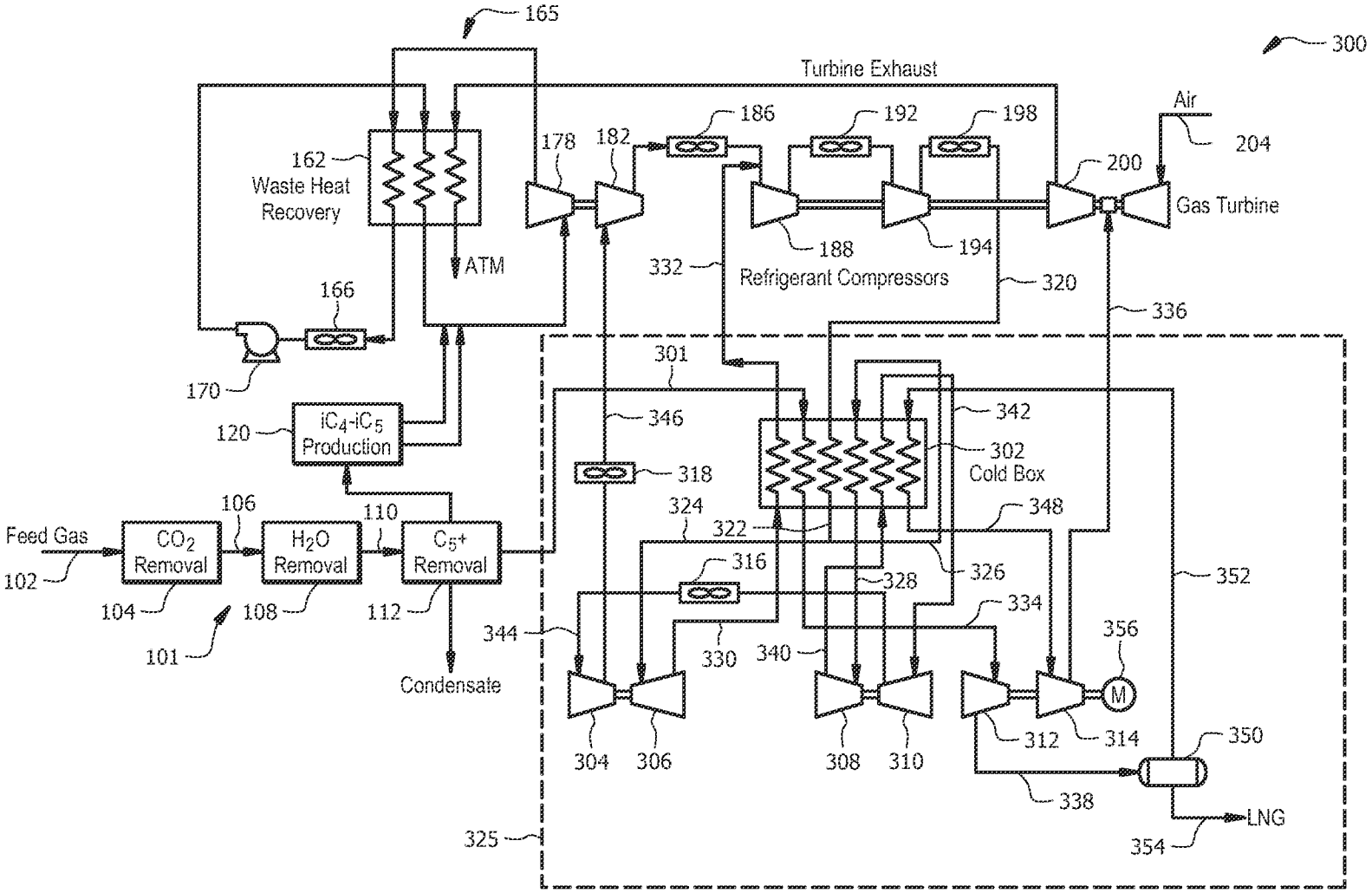
FIG. 4 is an equipment and process flow diagram for another embodiment of a LNG liquefaction plant or system using an internal refrigerant in accordance with principles disclosed herein.

In other embodiments, a LNG liquefaction plant or system includes concurrent power production where the working fluid for the cold box is an internal refrigerant, such as a LNG vapor or boil off gas. Referring now to FIG. 4, a LNG liquefaction plant or system 300 includes a treatment system 101, a heat exchanger system 325, and a waste heat recovery system 165. For the LNG liquefaction system 300 the treatment system 101 and waste heat recovery system 165 are similar to the corresponding systems in the LNG liquefaction system 100 described above. Therefore, most details of these systems will not be repeated except as needed to illuminate new or modified portions of the system 300 such as the heat exchanger system 325.

The heat exchanger system 325 includes a cold box or cryogenic exchanger 302 fed a natural gas stream by a conduit 301. The natural gas stream can be treated as described above with reference to the treatment system 101. In some embodiments, the treated gas stream in the conduit 301 is at a pressure of 1090 psig and a temperature of 85° F. The treated gas stream is liquefied and sub-cooled in the cold box 302 to produce a LNG stream in a conduit 334. In some embodiments, the LNG stream is a pressure of 1085 psig and a temperature of −243° F. The LNG stream is directed to an expander or hydraulic turbine 312 to produce an expanded LNG stream in a conduit 338. In some embodiments, the LNG stream is expanded to about atmospheric pressure (>1.0 psig), and in further embodiments is sub-cooled to −258° F. and stored in a storage tank 350 for LNG export in a conduit 354.

A compressor discharge stream with compressed and cooled refrigerant flows in a conduit 320 to the cold box 302 for liquefaction and sub-cooling of LNG. After the cold box 302, the refrigerant stream flows through a conduit 322 and is split between conduits 324 and 326. In some embodiments, the refrigerant stream is split at a ratio of 3:1 for the conduit 324 as compared to the conduit 326 (324:326). A first stream portion in the conduit 324 is directed to an expander 306 which in turn drives a compressor 304. The combination of 306, 304 may also be referred to as an expander-compressor or compander. The second stream portion in the conduit 326 is directed back through and out of the cold box 302 in a conduit 328 to an expander 308 which drives a compressor 310 (i.e., expander-compressor or compander 308/310). It is noted that, unlike the first stream portion 324, the second stream portion 326 is fed to the cold box 302 to thereby produce the stream 328 which is fed to the expander 308. Consequently, a first expanded stream, or low pressure working fluid vapor, flows from the expander 306 in a conduit 330 and a second expanded stream, or low pressure working fluid vapor, flows from the expander 308 in a conduit 340, both to the cold box 302. In some embodiments, the first and second expanded streams are at temperatures of about −245° F., and are used in respective heat exchange stages to facilitate LNG liquefaction in the cold box 302. In some embodiments, the arrangement described can also be referred to as a twin expander-compressor or twin compander assembly, used for compression of the internal refrigerant or working fluid derived from the LNG. While a two stage compander arrangement is shown, additional stages are also contemplated.

The refrigeration content of the second expanded stream in the conduit 340 is used for liquefaction in the cold box 302 to thereby produce a second warm LNG vapor or boil off gas stream in a conduit 342 (or, a warm intermediate stage working fluid vapor). The LNG vapor stream is then compressed in the compressor 310 to produce a compressed stream in a conduit 344, which is further compressed in the compressor 304 to produce a compressed stream in a conduit 346 that is recycled back to the first stage refrigerant compressor 182. Conduits 344, 346 can also include air coolers 316, 318 to further cool the compressed refrigerant streams. Similarly, the refrigeration content of the first expanded stream in the conduit 330 is used for liquefaction in the cold box 302 to thereby produce a first warm LNG vapor or boil off gas stream in a conduit 332 (or, a warm intermediate stage working fluid vapor) that is recycled back to the second stage refrigerant compressor 188. Consequently, the warm LNG vapor or boil off gas stream is the working fluid and provides refrigeration content in the cold box 302 for liquefaction. In some embodiments, the first expanded stream in the conduit 330 is at a pressure of about 380 psia, and the second expanded stream in the conduit 340 is at a pressure of about 35 psia.

A LNG vapor or boil off gas stream is directed from the storage tank 350 in a conduit 352, and the LNG vapor stream includes refrigeration content. The refrigeration content of the LNG vapor stream 352 can be used to supplement or optimize liquefaction of LNG in the cold box 302, prior to sending it as a fuel gas stream in a conduit 336 to the turbine 200. The LNG vapor stream 352 is directed through the cold box 302 and out of the cold box 302 in a conduit 348. The conduit 348 directs the LNG vapor stream to a compressor 314 that is coupled to and driven by the LNG expander 312. The compressed fuel gas stream is directed in the conduit 336 to the turbine 200 for power. In some embodiments, supplemental power for the compressor 314 can be provided by an electric motor 356. Furthermore, if additional power is required for the compressor 314, such power can be supplied from the power generation from the ORC (not shown).

In embodiments described above, the refrigeration content of LNG is employed in a LNG plant system by using the LNG as a working fluid in a multi-stage Rankine liquefaction cycle configuration, wherein the LNG vapor or boil off gas is compressed, cooled, expanded in a twin compander configuration and sub-cooled in multiple heat exchange states, wherein each of the exchange stages receives expanded working fluid vapors from respective turbines or turbine stages. In other words, in some embodiments, two Rankine cycles are fluidicly coupled to the LNG liquefaction plant system, including two, three, or more expansion stages.

Figure 5:
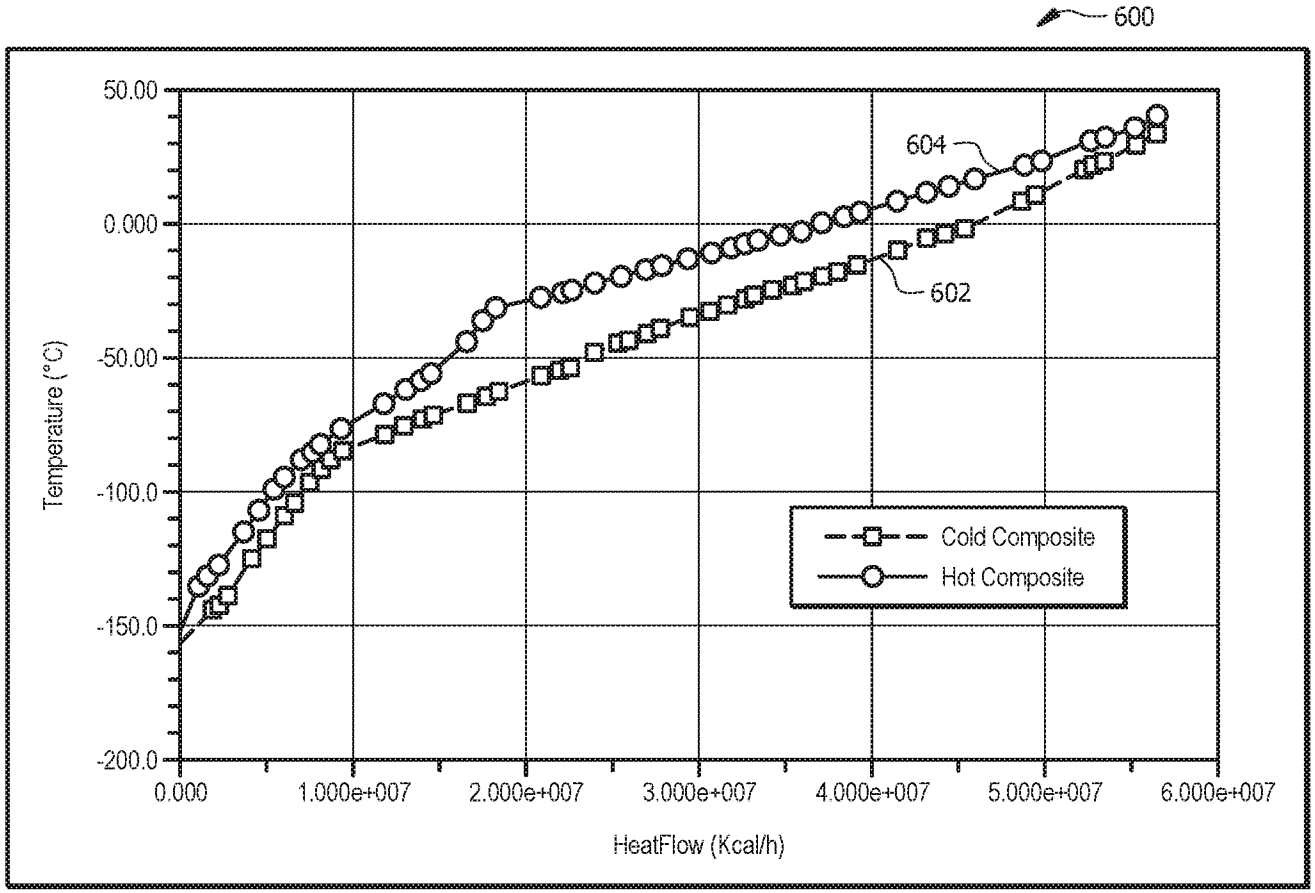
FIG. 5 is a diagram showing the composite heat curves between LNG and an internal refrigerant as a working fluid using a cold box.

As described above, the refrigeration content of both the LNG and the internally derived LNG refrigerant working fluid are used for LNG liquefaction in various embodiments described herein. Referring to FIG. 5, a graph 600 shows a composite heat curve 602 for the internal refrigerant working fluid and a composite heat curve 604 for the LNG, using heat flow (kcal/h) as a function of temperature (° C.). The internal refrigerant working fluid compositions and condensation temperatures are also dependent on the operating pressures. As described herein, multiple stages, e.g., more than two stages, of compression will further narrow the temperature gaps between the internal refrigerant working fluid and LNG, reducing loss work and increasing liquefaction efficiency.

Figure 6:
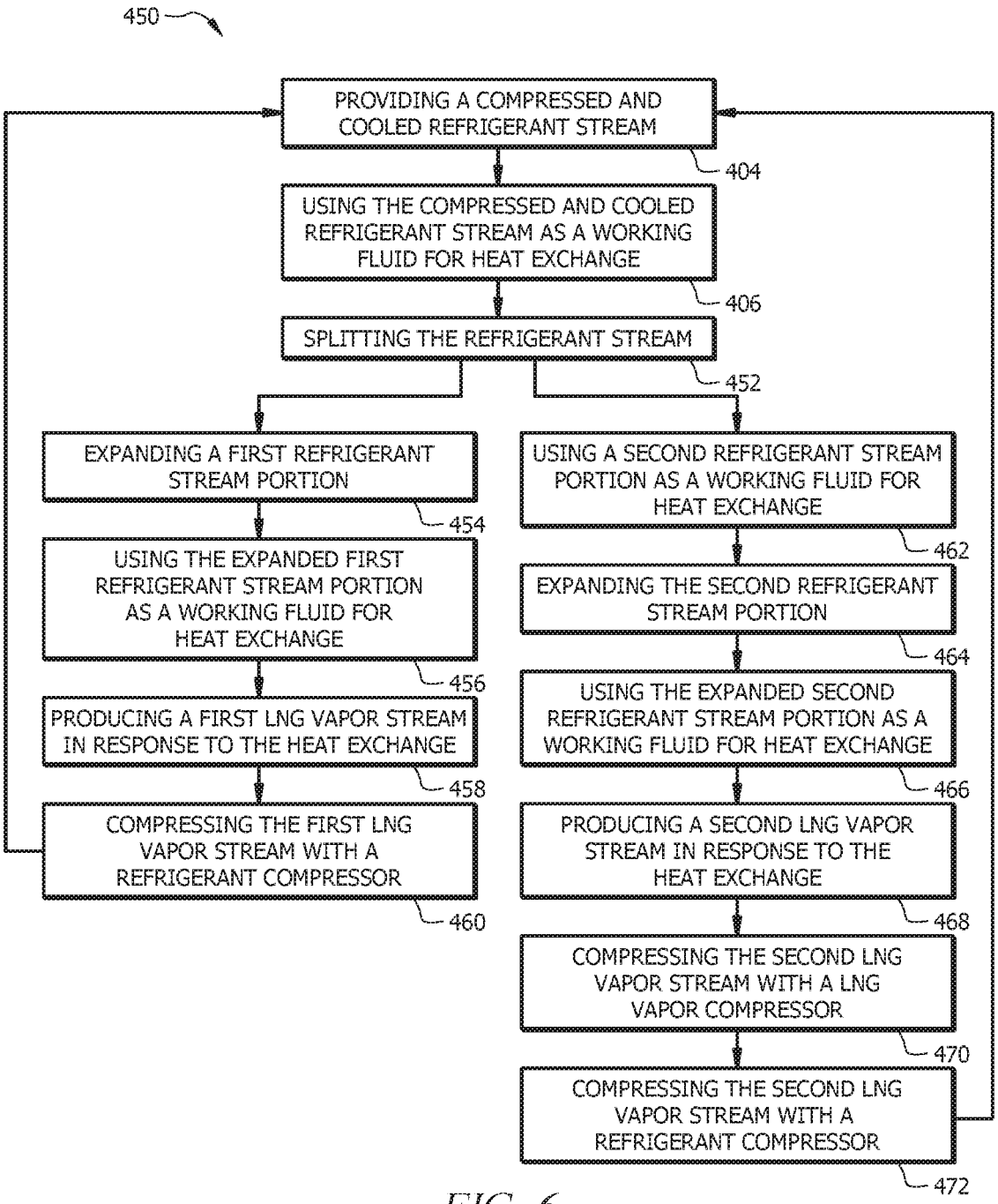
FIG. 6 is a flow chart for an embodiment of a method of LNG liquefaction using an internal refrigerant in accordance with principles disclosed herein.

Referring now to FIG. 6, an extension of the method 400 is illustrated as a method 450 including the steps 404 and 406. After the heat exchange of step 406, the refrigerant stream is split at 452. Next, the method 450 includes expanding a first refrigerant portion 454, using the expanded first refrigerant stream portion as a working fluid for heat exchange 456, producing a first LNG vapor stream in response to the heat exchange 458, and compressing the first LNG vapor stream with a refrigerant compressor, such as, for example, using the stream 332 directed into the second stage refrigerant compressor 188. Then, the method 450 also includes using a second refrigerant stream portion as a working fluid for heat exchange 462, expanding the second refrigerant portion 464, using the expanded second refrigerant stream portion as a working fluid for heat exchange 466, producing a second LNG vapor stream in response to the heat exchange 468, compressing the second LNG vapor stream with a LNG vapor compressor (such as, for example, with the compressors 304, 310 that are part of the heat exchanger system 325), and compressing the second LNG vapor stream with a refrigerant compressor (such as, for example, the first stage refrigerant compressor 182).

In various embodiments described herein, LNG can be produced at a rate of 1.0 MTA.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A method for LNG liquefaction, the method comprising:

providing a natural gas feed stream;

providing, in a heat exchanger, heat exchange between the natural gas feed stream and a compressed and cooled refrigerant stream, wherein the heat exchange heats the compressed and cooled refrigerant stream;

after the heat exchange in the heat exchanger, splitting the compressed and cooled refrigerant stream into a first refrigerant portion and a second refrigerant portion;

expanding, in a first expander, the first refrigerant portion to produce an expanded first refrigerant stream portion;

using the expanded first refrigerant stream portion in the heat exchanger to cool the natural gas feed stream, where the expanded first refrigerant stream portion is heated in the heat exchanger to produce a first warm LNG vapor stream;

compressing the first warm LNG vapor stream with a first refrigerant compressor;

using the second refrigerant portion in the heat exchanger to cool the natural gas feed stream, wherein the second refrigerant portion is heated in the heat exchanger to produce a warmed refrigerant stream;

expanding, in a second expander, the warmed refrigerant stream to produce an expanded second refrigerant stream portion; and using the expanded second refrigerant stream portion in the heat exchanger, wherein the expanded second refrigerant stream portion is heated in the heat exchanger to produce a second warm LNG vapor stream.

2. The method of claim 1, where a volumetric flow ratio of the first refrigerant portion to the second refrigerant portion is 3:1.

3. The method of claim 1, further comprising:

compressing the second warm LNG vapor stream in a first compressor to produce a compressed second LNG vapor stream.

4. The method of claim 3, wherein the first compressor is mechanically coupled to the second expander.

5. The method of claim 3, further comprising:

compressing the compressed second LNG vapor stream in a second compressor to form a second LNG vapor stream.

6. The method of claim 5, wherein the second compressor is mechanically coupled to the first expander.

7. The method of claim 5, further comprising:

cooling the compressed second LNG vapor stream prior to compressing the compressed second LNG vapor stream in the second compressor.

8. The method of claim 5, further comprising:

compressing the second LNG vapor stream with a second refrigerant compressor.

9. The method of claim 8, where the second refrigerant compressor forms a first stage in a refrigerant compressor system.

10. The method of claim 9, wherein the first refrigerant compressor forms a second stage or third stage of the refrigerant compressor system.

11. The method of claim 1, further comprising:

directing a gas stream from the produced LNG; and using the gas stream in the heat exchanger for heat exchange with the natural gas feed stream.

12. The method of claim 1, further comprising:

liquefying the natural gas feed stream in the heat exchanger to produce LNG.

13. The method of claim 12, further comprising:

storing the LNG in a storage tank downstream of the heat exchanger, directing a gas stream from the storage tank to the heat exchanger;

passing the gas stream from the heat exchanger to a third compressor;

compressing the gas stream in the third compressor into a fuel gas stream, wherein the fuel gas stream is used in a compressor driver to drive the first refrigerant compressor.

14. The method of claim 1, wherein the heat exchanger is a cold box.

15. The method of claim 1, further comprising:

treating the natural gas feed stream to remove one or more components in a natural gas treatment system before the providing the heat exchange between the natural gas feed stream and the compressed and cooled refrigerant stream.

* * * * *